US007779570B2

(12) United States Patent
Riley

(10) Patent No.: US 7,779,570 B2
(45) Date of Patent: Aug. 24, 2010

(54) BUSINESS FORM WITH WRISTBAND HAVING CLAMSHELL AND STRAP

(75) Inventor: James M. Riley, St. Louis, MO (US)

(73) Assignee: Laser Band, LLC, St. Louis, MO (US)

( * ) Notice: Subject to any disclaimer, the term of this patent is extended or adjusted under 35 U.S.C. 154(b) by 0 days.

(21) Appl. No.: 11/763,615

(22) Filed: Jun. 15, 2007

(65) Prior Publication Data

US 2008/0028655 A1 Feb. 7, 2008

Related U.S. Application Data

(60) Division of application No. 11/253,041, filed on Oct. 18, 2005, now Pat. No. 7,461,473, which is a division of application No. 10/283,777, filed on Oct. 30, 2002, now Pat. No. 7,017,293, which is a continuation-in-part of application No. 10/256,758, filed on Sep. 27, 2002, now Pat. No. 7,047,682.

(51) Int. Cl.
*A44C 5/00* (2006.01)

(52) U.S. Cl. ..... 40/633; 283/75

(58) Field of Classification Search ..... 40/633, 40/6; 428/40.1, 42.2, 42.3, 43
See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |
| 1,383,335 | A | 7/1921 | Penksa |
| 1,517,456 | A | 12/1924 | Pulliam |
| 2,054,227 | A | 9/1936 | Nichols |
| 2,073,280 | A | 3/1937 | Lederer |
| 2,553,676 | A | 5/1951 | Roos |
| 2,641,074 | A | 6/1953 | Richmond |
| 2,687,978 | A | 8/1954 | Vogt |
| 3,153,869 | A | 10/1964 | Twentier |
| 3,197,899 | A | 8/1965 | Twentie |

(Continued)

FOREIGN PATENT DOCUMENTS

| | | |
|---|---|---|
| EP | 1039431 | 9/2000 |

(Continued)

OTHER PUBLICATIONS

Brochure entitled: "Integrated Document Management Software"; Smead Manufacturing Company; Date Unknown; Form No. SLI-95.

(Continued)

*Primary Examiner*—Joanne Silbermann
(74) *Attorney, Agent, or Firm*—Thompson Coburn LLP

(57) ABSTRACT

A wristband device which is adapted to at least partially surround a person's wrist is described which includes a clamshell joinder and a tail portion. The clamshell portion comprises a pair of similarly sized panels and may be folded over onto itself to capture a length of a wristband to complete the encircling of a wrist. It may be provided on a page sized sheet, and die cut into a laminate ply of a two ply business form, along with a plurality of self adhering labels, in any of a number of configurations, to suit any particular application, as desired by a user.

18 Claims, 13 Drawing Sheets

U.S. PATENT DOCUMENTS 3,402,808 A 9/1968 Yannuzzi
3,517,802 A 6/1970 Petrie
3,660,916 A 5/1972 McDermott et al.
3,854,229 A 12/1974 Morgan
4,004,362 A 1/1977 Barbieri
4,078,324 A 3/1978 Wiebe
4,179,833 A 12/1979 Knodel
4,226,036 A 10/1980 Krug
4,233,715 A 11/1980 McDermott
4,370,370 A 1/1983 Iwata et al.
4,612,718 A 9/1986 Golub et al.
4,627,994 A 12/1986 Welsch
4,630,384 A 12/1986 Breen
4,682,431 A 7/1987 Kowalchuk et al.
4,696,843 A 9/1987 Schmidt
4,783,917 A 11/1988 Smith et al.
4,829,604 A 5/1989 Allen et al.
4,854,610 A 8/1989 Kwiatek
4,855,277 A 8/1989 Walter
4,914,843 A 4/1990 DeWoskin
4,941,210 A 7/1990 Konucik
4,950,638 A 8/1990 Yuyama et al.
4,956,931 A 9/1990 Selke
4,991,337 A 2/1991 Solon
RE33,616 E 6/1991 Welsch
5,026,084 A 6/1991 Pasfield
5,045,426 A 9/1991 Maierson et al.
5,135,789 A 8/1992 Schmidt
5,222,823 A 6/1993 Conforti
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,351,993 A 10/1994 Wright et al.
5,370,420 A 12/1994 Khatib et al.
5,383,686 A 1/1995 Laurash
5,418,026 A 5/1995 Dronzek, Jr. et al.
5,427,416 A 6/1995 Birch et al.
5,486,021 A 1/1996 Laurash
5,486,436 A 1/1996 Lakes
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A * 10/1996 Morgan ..... 283/80
5,581,924 A 12/1996 Peterson
5,586,788 A 12/1996 Laurash
5,595,404 A 1/1997 Skees
5,596,202 A 1/1997 Arakawa
5,598,970 A 2/1997 Mudry et al.
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,670,015 A 9/1997 Finestone et al.
5,687,903 A 11/1997 Akridge et al.
5,765,885 A 6/1998 Netto et al.
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A 1/2000 Attia et al.
6,053,535 A 4/2000 Washburn et al.
6,055,756 A 5/2000 Aoki
6,058,639 A 5/2000 Tinklenberg et al.
6,067,739 A 5/2000 Riley
6,071,585 A 6/2000 Roth
6,092,321 A 7/2000 Cheng et al.
6,108,876 A 8/2000 Hubbert
6,155,476 A 12/2000 Fabel
6,155,603 A 12/2000 Fox
6,159,570 A 12/2000 Ulrich et al.
6,199,730 B1 3/2001 Chisolm
6,303,539 B1 10/2001 Kosarew
6,331,018 B1 12/2001 Roth et al.
6,343,819 B1 2/2002 Shiozaki
6,361,078 B1 3/2002 Chess
6,409,871 B1 6/2002 Washburn et al.
6,438,881 B1 8/2002 Riley
6,510,634 B1 1/2003 Riley
6,517,921 B2 2/2003 Ulrich et al.
6,611,962 B2 9/2003 Redwood et al.
6,641,048 B1 11/2003 Schintz et al.
6,685,228 B2 2/2004 Riley
6,748,687 B2 6/2004 Riley
6,807,680 B2 10/2004 Sloot
6,836,215 B1 12/2004 Laurash et al.
6,863,311 B2 3/2005 Riley
6,981,948 B2 1/2006 Pellegrino et al.
7,017,293 B2 3/2006 Riley
7,017,294 B2 3/2006 Riley
7,047,682 B2 5/2006 Riley
7,222,448 B2 5/2007 Riley
7,240,446 B2 7/2007 Bekker
7,523,576 B1 4/2009 Petty
2002/0152928 A1 10/2002 Lawandy et al.
2002/0176973 A1 11/2002 Keiser
2003/0001381 A1 1/2003 Riley
2003/0011190 A1 1/2003 Ryan
2004/0068906 A1 4/2004 Riley
2004/0128892 A1 7/2004 Valenti
2004/0244251 A1 12/2004 Riley
2005/0091896 A1 5/2005 Kotik et al.
2005/0108912 A1 5/2005 Bekker
2005/0279001 A1 12/2005 Riley
2005/0281989 A1 12/2005 Finger
2006/0230661 A1 10/2006 Bekker
2006/0236578 A1 10/2006 Saint et al.
2007/0089342 A1 4/2007 Jain et al.
2007/0120358 A1 5/2007 Waggoner et al.
2009/0094872 A1 4/2009 Ali et al.
2009/0277061 A1 11/2009 Jain et al.
2009/0282717 A1 11/2009 Jain et al.
2010/0071241 A1 3/2010 Jain et al.

FOREIGN PATENT DOCUMENTS

FR 2806594 A 9/2001
GB 960859 6/1964
GB 2045718 11/1980
GB 2160492 12/1985
GB 2228915 A 9/1990
JP 5-61777 8/1993
JP 08-190350 7/1996
JP 3032299 12/1996
JP 10-207374 8/1998
JP 11015383 A 1/1999
JP 2001316921 A 11/2001
JP 2002351321 A 12/2002
JP 2003066849 3/2003
JP 2003157010 5/2003
JP 2003164307 6/2003
JP 2006039209 2/2006
WO 9612618 5/1996
WO 98/23081 5/1998
WO 99/18817 4/1999
WO 02/039412 5/2002
WO 03/003331 1/2003

| | | |
|---|---|---|
| WO | 2004/028826 | 4/2004 |
| WO | 2005/064574 | 7/2005 |
| WO | 2006/007356 | 1/2006 |
| WO | 2007/021375 | 2/2007 |
| WO | 2007/133906 | 11/2007 |
| WO | 2009/137195 | 11/2009 |

OTHER PUBLICATIONS

Catalog entitled: "Reseller Catalog No. One"; Smead Software Solutions ; Date Unknown; Form No. SSS-RC1-00.
Sample of Standard Register Labels.
Standard Register, P.S. Magazine, Fall 1998, Dayton, Ohio.
Gretchen Berry, "Wrist Watch," Advance for Healthcare Information Professionals, Feb. 15, 1999.
Sample of Standard Register Label.
"Yes, Sir, That's My Baby!," Material Management in Health Care, Feb. 1999, vol. 8, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.
Avery Dennison DuraCard.
Avery Laminated Identification Cards #5361.
Brochure entitled: "Color-Barâs—Click Stripä Labeling System"; Smead Manufacturing Company; Date Unknown; Form No. SSS-CS-00.
Brochure entitled: "Color-Bar â Folders"; Smead Manufacturing Company; Date Unknown.
ID Warehouse (http://web.archive.org/web/20050131235601/http://idwarehouse.com/) Jan. 31, 2005. p. 1: WB1908, Stock Vinyl Wristband.
International Search Report for PCT/US2009/031979 dated Mar. 9, 2009.
Office Action for U.S. Appl. No. 11/553891 dated Mar. 19, 2009.
Office Action for AU Application 2006280450 dated Sep. 14, 2009.
Office Action for CN Application 200580019868.5 dated Sep. 4, 2009.
Office Action for EP Application 03773060.3 dated Aug. 11, 2009.
Office Action for U.S. Appl. No. 12/026,030 dated Oct. 8, 2009.
Office Action for U.S. Appl. No. 12/252,710 dated Oct. 15, 2009.
International Preliminary Report on Patentability (Chapter I) for PCT/US2008/064972 dated Dec. 1, 2009.
Office Action for U.S. Appl. No. 11/405,149 dated Dec. 28, 2009.
Office Action for U.S. Appl. No. 11/456,928 dated Dec. 8, 2009.
Office Action for U.S. Appl. No. 11/735,078 dated Nov. 17, 2009.
Office Action for U.S. Appl. No. 12/509,151 dated Nov. 13, 2009.
International Preliminary Report on Patentability (Chapter II) for PCT/US2009/039183 issued April 20, 2010.
International Preliminary Report on Patenability (Chapter II) for PCT/US2009/031979 issued May 21, 2010.

* cited by examiner

BUSINESS FORM WITH WRISTBAND HAVING CLAMSHELL AND STRAP

CROSS REFERENCE TO RELATED APPLICATIONS

This application is a divisional of Ser. No. 11/253,041 filed Oct. 18, 2005 (currently pending), which is a divisional of Ser. No. 10/283,777 filed Oct. 30, 2002 (now U.S. Pat. No. 7,017,293), which is a continuation-in-part to Ser. No. 10/256,758 filed Sep. 27, 2002 (now U.S. Pat. No. 7,047, 682).

BACKGROUND AND SUMMARY OF THE INVENTION

There are many situations where it would be convenient to have available a way to separately identify a person, such as a health care patient, with his/her possessions or other related items with which the person needs to be associated. As this is written, the recent events of the tragedy of Sep. 11, 2001 have provided a glaring example of one such situation. In that situation, it became evident that there was no convenient way to associate people desperately in need of health care with their belongings. Even more horrifying was the need to identify body parts, tag them, and assemble some kind of data base that could be used to sort through the confusion and chaos created on that terrible day. Under those circumstances, and many other similar emergency circumstances, the health care workers and the emergency workers are under tremendous time pressure, with protective clothing such as gloves being used to avoid personal danger to themselves, to sort through what is presented to them in the way of victims needing medical attention, their possessions including valuables, and a need to communicate with their family. The environment is usually hostile, with what may be fire, flying debris, collapsing buildings, un-breathable air, etc. which makes it quite different from a usual hospital or other controlled environment and makes handling any "standard" form imminently more difficult.

Another aspect to the situation that must be considered is that it is not uncommon for different care takers to handle a single victim. Generally, when a victim is first attended, he is categorized for the nature and extent of his injuries. Then, in those situations where there is a mis-match between the number of victims and the number of medical personnel, the most severely injured are attended to first and the remainder are treated as time becomes available. This is routine, and an attempt to minimize loss of life in what can be a desperate situation. Thus, it is commonly required to "triage" the victims, and then identify them in some way that makes it immediately apparent to medical workers just what their medical situation is. This sounds easy, but in the chaos of these situations, even with medical personnel who are well trained, there can be lost time in this process and if a good strategy is not used for this classifying, victims can be mis-identified or their status not readily ascertainable after classification, so that the precious time of these "angels of mercy" can be needlessly wasted as they move from one victim to another.

This type of emergency situation creates needs that are unique, beyond the needs of a form intended for use in a clean environment available in an emergency room. As mentioned, medical personnel are usually wearing gloves and in a hurry. Thus, any form that would be used must be adapted to be easily handled with clumsy fingers. There is no time for instruction, so the form must be virtually intuitive for use. There are commonly fluids present, unfortunately most often blood and other body fluids, so the form must be protected. There needs to be a simple, fast, fool-proof way to apply the form to the victim, and his possessions, with a reliable way to link them together. There is a further need to be able to quickly collect the identifying information from the form as it is attached to a victim so he may be processed quickly and the information accurately collected. The identifying information commonly needs to be thought out in advance, and might even be pre-coded to mesh with the triage operation so that merely knowing the identifying information conveys some information about victim medical status. And, there is desirably some flexibility available in use of the form to accommodate different victim conditions.

Still another need exemplified by this tragedy is that of providing information to families and other loved ones. After the 9/11 event, it was well publicized that family members and others resorted to walking the streets, following any rumor, visiting geographically separated emergency medical care sites, asking for information if not finding their loved one. This itself caused much anxiety and pain amongst the survivors. While not as critical as getting information about survivors to their families, this inability to assemble information created other problems including the inability to gauge the magnitude of the tragedy. A complete list of the survivors was impossible to assemble for days, even though information was individually available by then. There just was not a convenient way to assemble this information in a common data base. Some attempts were made to use the internet, but inaccuracies abounded and the information posted there was soon being ignored, at least part due to the lack of confidence in that information.

To solve these and other needs in the prior art, the inventor herein has previously developed a business form as disclosed and claimed in the parent in several embodiments and a method incorporating the use of that form that have particular application to these kind of medical emergency situations. Briefly, a first embodiment of the form comprises a carrier sheet of paper stock, with a wristband/label assembly die cut thereinto for separation from the carrier sheet. The paper stock is preferably pre-printed with identifying indicia, color coded and covered top and bottom with a layer of protective coating which may preferably be a poly plastic. The wristband/label assembly may be dry adhered to a bottom layer of a carrier film so that it may be readily separated from the carrier without retaining any adhesive. The wristband portion of the assembly may have a tab on one end and a long strap portion which, to be assembled, is wrapped around an object such as a victim's wrist, looped back through a "cinch" comprising a slot in the tab and then adhered to itself by an adhesive portion at the end of the strap portion. The tab preferably has a plurality of individually separable labels die cut thereinto, with each of the labels and the wristband having an identifying indicia which may preferably be a bar code.

In use, the wristband/label assembly of the parent is separated from the carrier, carrying the tab filled with labels, and the strap portion. The cinch slot is die cut and formed as the assembly is separated with its filler piece adhered to remain behind with the bottom film carrier sheet. The strap portion has its end covered with a laminated bottom patch so that as it separates it carries with it a peel away covering over its end having the adhesive. After being separated from the carrier, the wristband/label assembly has a protective layer over both its top and bottom for resisting fluid contamination and the tab has a label section which may be perforated for separation from the wristband. Each of the labels are individually separable and carry the identifying indicia. The wristband may preferably be color coded, and the forms may be made in sets with multiple ones of each of a number of different colors. Alternately, color coded, perforated tabs may be provided at the end of the tab portion, such that the medical technician need only separate one or more tabs, leaving as the outside tab the correct one to visually indicate the condition of the victim. A blank tab is preferably provided at the very edge of the tab portion so that no one would mistakenly interpret the failure to separate a tab as a conscious attempt at indicating medical condition. The wristband may be readily applied by wrapping the strap portion about the person's appendage, slipping it through the "cinch" comprising the slot to tighten it about the appendage, pulling it tight, and then folding the strap portion back onto itself for attachment with the adhesive after removing the peel away covering.

In a second embodiment as shown and described in the parent, the wristband/label assembly is pre-printed and formed in its final configuration, with a tab/label portion and a strap portion made from preferably four layers. A top, clear film layer overlies and protects a face stock layer upon which the pre-printed information including bar codes and color "condition" codes applied thereto. A layer of adhesive then joins the face stock to a base film material, again to protect the face stock in use. In either embodiment, more than one slot, or "cinch" point, may be provided to allow for a snug fit to different sized body parts. Also, more or fewer bar coded labels, of smaller or larger size, may be selected for use to suit a designer's preferences or user's needs.

In the method of the parent invention, once a form has been applied to a victim, and the victim thus associated with an identifying indicia, and his possessions properly tagged, software pre-loaded into a computer may then receive as much information about the victim as is available. Items of information might include his associated color code (which would preferably be indicative of his medical condition), his name and other demographic information, his statistics such as height, weight, race, etc., more detailed information as to the nature of his injuries or condition, the location where this victim is processed, and other appropriate information. The computer may then go on-line, or be on-line, and the data set up-linked to a web site. A plurality of treatment centers could each be simultaneously processing victims, and transmitting data to the web site for ready access and display to anyone interested in learning about a victim's condition. As a victim's condition changes, updated information could be provided to the web site, although it is considered by the inventor that the method of the parent is most effective in providing early information as fast as possible to the most people. Updated information could be available more directly as a victim's family locates and goes to where treatment is being given. Security in the web site and data links would prevent any mischief from occurring which might compromise the integrity of the data such that families could rely on the information posted.

As can be appreciated by those of ordinary skill in the art, there is unfortunately need for the parent invention given the heightened risk of terrorism that the world now faces, and along with that arises an increased need to facilitate not only the quick processing of victims but also the task of collecting and disseminating information about these victims. The parent invention addresses these needs, which in actuality are long felt needs exacerbated by our changing times. Accordingly, the foregoing provides a brief description of some of the advantages and features of the parent invention. A fuller understanding may be attained by referring to the drawings and description of the preferred embodiment of the parent which follow.

The inventor has taken several of the features of the parent invention and used it to build onto his prior work in the wristband art as exemplified by the following patents issued to the inventor herein, the disclosures of which are incorporated herein by reference: U.S. Pat. Nos. 6,438,881; 6,067,739; 6,000,160; and others still pending. In his new invention, he has incorporated the "cinch" of the parent into a self laminating wristband form in a unique and non-obvious way to provide many advantages and features not hereto available. Although the present invention is exemplified in several embodiments as explained in greater detail below, each of which has its own unique advantages and features, the present wristband invention represents a departure from the construction found in the inventors prior patents. Some of the differences include the use of a single, preferably narrow, strap portion extending generally from one side of the face stock region, with the cinch comprising a slot located on either side of the face stock and either adjacent the top or bottom portion of the laminating portion that overlies the face stock. With this construction, it is thought that several advantages are obtained over the wristband construction of his prior inventions. First, in this invention the inventor uses less face stock resulting in a smaller area of the form needing to be over-laminated. In other words, in the inventor's prior wristbands, virtually the entire length of the wristband comprised face stock, all of which was over-laminated. In the present invention, preferably only a "patch" of face stock is used which does reduce the amount of space for printing but which at the same time reduces the size of the over-lamination "patch" needed. This smaller over-lamination "patch" is much easier for a nurse or other medical professional to fold over and complete the assembly, and thus apply the wristband to the patient. A related advantage is that by eliminating the face stock from the "strap portion" that surrounds the patient's wrist, this strap portion may be narrower and formed from a single layer of the lamination (with no adhesive applied). This more comfortable to the patient for several reasons. The strap is narrower, thereby being less likely to bind or press into the patient's skin as he moves his wrist in doing daily living activities. The strap is also thinner as it is formed from only a single layer and may thus be more flexible. In this construction, a thinner laminate may be used than in prior designs which increases the patient's comfort. Patient comfort is an important consideration as patient's in hospitals are generally uncomfortable to begin with, being out of their ordinary environment, and those in need of hospital care are generally infirm, older or younger such as prenatal, and their skin may be more sensitive than normal. So, this is an important design criteria.

Still another advantage comes through incorporation of the cinch in this design. The cinch preferably comprises a slot which may be located in one of several places in the wristband, but it offers several unique advantages. First, if need be, the cinch may be used to more easily apply the wristband to a patient as it gives the nurse a ready attachment fixture with which he/she is quite familiar, it being much like an ordinary belt worn by almost everyone, male and female. For those patients who may be uncooperative or thrashing about or otherwise resistive, applying the wristband amounts to getting the strap through the slot and after that is achieved the rest needed to be done is relatively simple. For those patients who need to be tightly banded, the cinch provides a ready means to tighten down the strap and keep it tight while the cinch and strap are adhered in place. This allows for a simpler built in adjustment in strap length than with the prior designs. The cinch may be located in one of several places in the band, and each location offers its own unique advantages. If located intermediate the face stock and the strap, the face stock is converted into a "hang tag" which hangs freely from the patient's wristband after it is applied. This aids the nurse in finding and reading the information printed on the face stock, and also makes it easier for her to read imprinted indicia on the face stock with a hand held bar code reader, for example, as the surface is flat. Also, with this arrangement, a smaller strap is readily provided for smaller wrists such as with newborn babies. If located outboard from the face stock, the face stock hugs the patient's wrist much more like a conventional wristband, and an extra area of fold over laminate may be used to adhere the strap in place, making for a more secure attachment. Either arrangement would be desirable depending on the particular application, and is left to the user's choice.

As alluded to above, the strap portion is adhered in one of several ways, depending on the embodiment chosen. If the cinch is intermediate the face stock and strap, the end of the strap has a patch of adhesive which is used to adhere it back onto itself after being threaded through the slot. With the cinch outboard of the face stock, an "extension" of laminate is used which may carry adhesive along with a fold line through the slot so that after the strap is threaded through the slot the extension may be folded about the fold line and "clamp" the strap in place with adhesive. This provides a second means for adhering the strap in place.

The face stock layer has a printable region or ply defined therein with a die cut while the lamination layer has three elements die cut in to it. The lamination layer has a strap portion, a laminating portion, and a cinch portion all die cut therein, with adhesive being applied to preferably the extreme end of the strap portion for securing the strap to itself after the wristband has been applied, adhesive applied to the lamination portion to substantially, and preferably entirely, surround and enclose the face stock printable region, and adhesive applied to a cinch portion (if located outboard of the face stock) for adhering to the strap portion after it is passed through the cinch. Adhesive may preferably be omitted from the portion of lamination that overlies the face stock to improve it's readability, both visually and for bar coding. In variations to this embodiment, the cinch, which is preferably a slot aligned generally perpendicular to the face stock, may be located in one of several places, either outboard of the face stock region or intermediate the face stock and the strap portion. When positioned outboard of the face stock, the cinch may also be located in one of two places either in an extension of the lamination adjacent a top portion or the bottom portion of the lamination portion. When positioned intermediate the face stock and strap portion, the cinch may be formed from a pair of slots located in both the top and bottom portion of the lamination portion. In this arrangement, adhesive is applied to join the top and bottom lamination portions, but it does not aid in holding the strap in position unless the nurse takes the time and is able to obtain the cooperation of the patient to thread the strap through only one of the slots before folding the lamination halves together to enclose the face stock. However, this is thought to be a less desirable attachment arrangement than first enclosing the face stock and then threading the strap through the slot.

As an added feature, the inventor has developed an extender which is also formed in the same two plies of material, with the extender comprising a length of laminate having a fold over or "clamshell" portion with adhesive at one end, and a patch of adhesive at its opposite end. The extender is sized preferably to be of the same width as the strap portion and is applied to the strap portion by use of the clamshell which clamps onto the strap portion and along its length, with the extender patch of adhesive serving the function of joining the strap. With the extender, the wristband may be used with larger patient's, conveniently, without being limited to the overall length of the form or carrier in which the wristband is formed.

In variations of these embodiments, the novel wristband of the present invention may be formed in a sheet with a plurality of self adhering, peel off labels, all of which may be printed with identifying indicia or information relating to the patient. Several wristbands of different size, or the same size, may also be formed on a single sheet, with or without labels. The extender may also be provided in any one or more of the variations, which are only limited by the perceived needs of users, and design choice.

While the principal advantages and features of the present invention have been explained above, a fuller understanding of the invention in all of its various embodiments may be attained by referring to the drawings and description of the preferred embodiments below.

DETAILED DESCRIPTION OF THE PREFERRED EMBODIMENT

Figure 1:
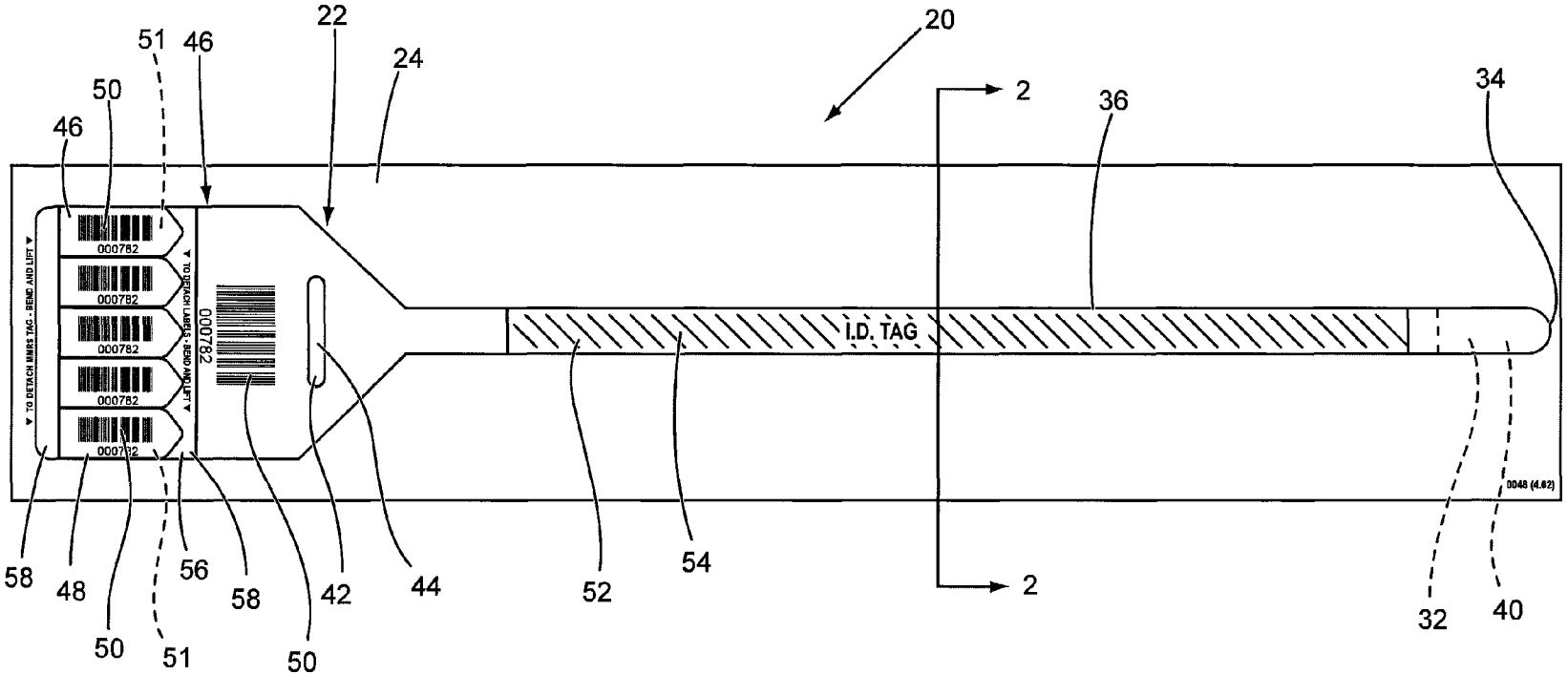
FIG. 1 depicts a top view of the first embodiment of the business form of the parent invention prior to the wristband/label assembly being separated from the carrier.
Figure 2:
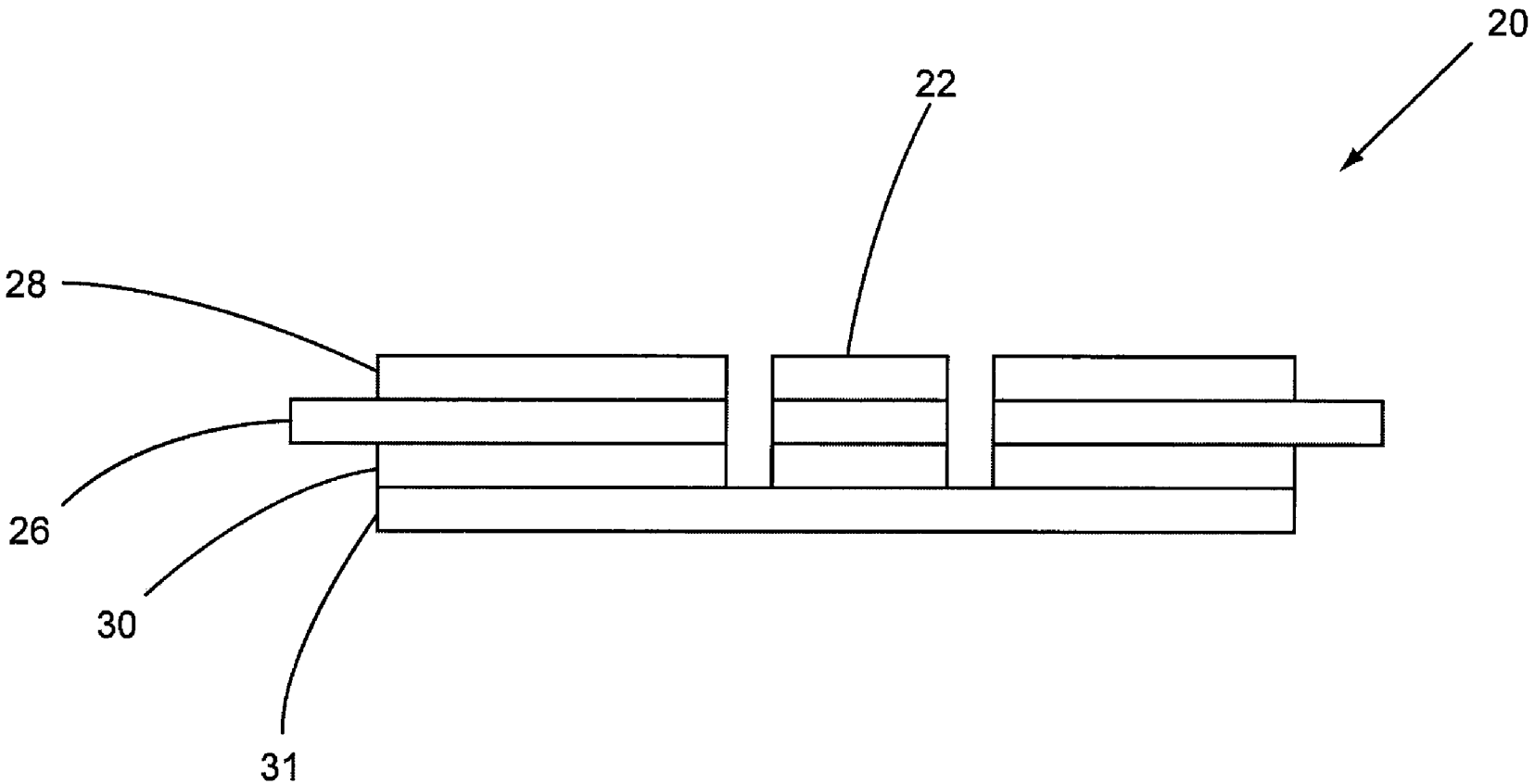
FIG. 2 is a side view of the first embodiment as shown in FIG. 1.
Figure 3:
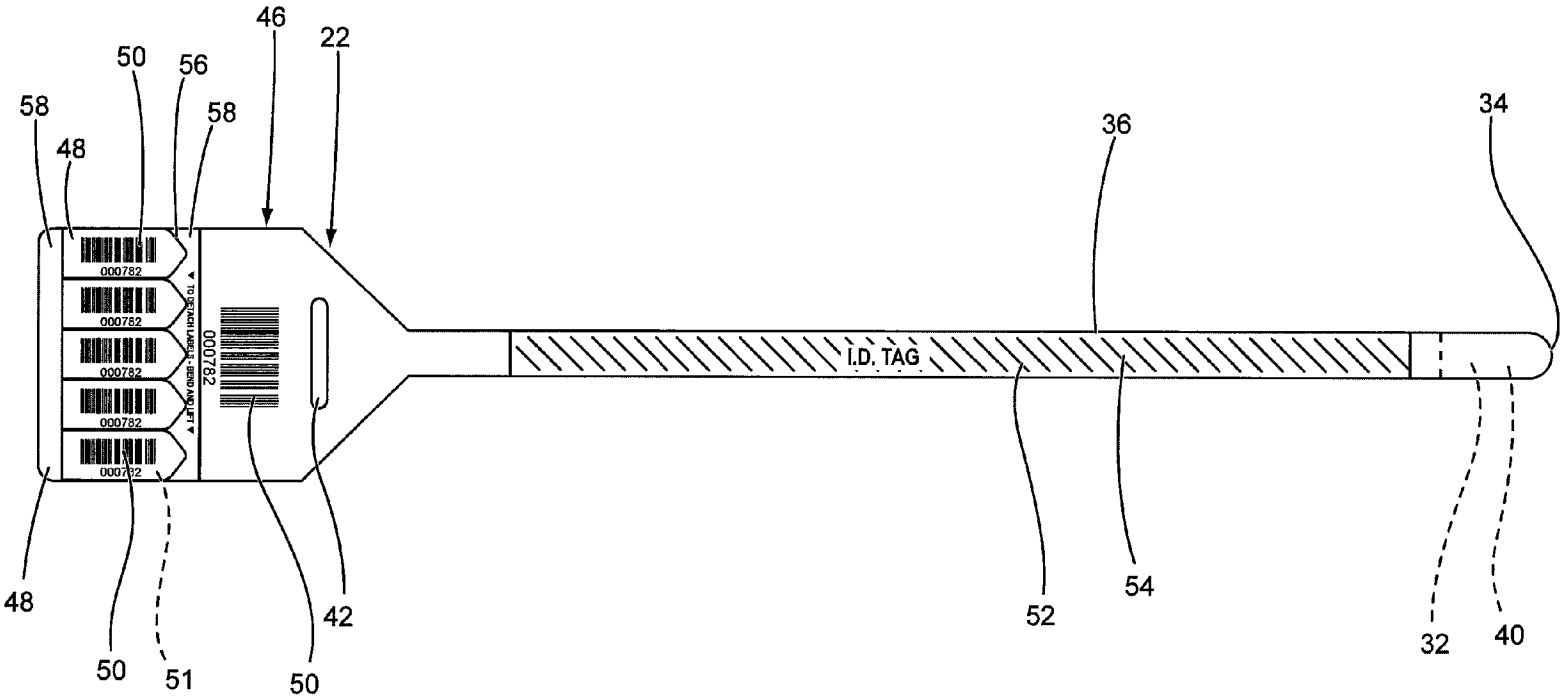
FIG. 3 is a top view of the wristband/label assembly after separation from the carrier of the first embodiment.

As shown in FIGS. 1-3, the first embodiment of the business form 20 of the parent invention generally includes a wristband/label assembly 22 die cut into a carrier 24 making an overall size of preferably approximately three and a half inches by seventeen inches, (3½"×17"). Generally, the business form 20 is assembled with a three web construction, with a poly laminated paper center web 26 sandwiched between a pair 28, 30 of thin film poly, transparent webs, and this is then dry adhered to a carrier web 31. The poly coated paper web 26 is dry adhered to the carrier web 31 so that it may be separated therefrom along its die cut to remove the wristband/label assembly 22 from the carrier 24. At an end of the form 20, an adhesive 32 is applied to the single end 34 of the wristband portion 36 of the wristband/label assembly 22. A separate patch 40, preferably made of paper with a release coating, covers the adhesive 32, with the webs die cut so that a portion of the patch 40 covering the adhesive 32 separates with the single wristband end 34 as it is separated from the carrier 24. A "cinch" comprising a slot 42 is formed when the wristband/label assembly 22 is separated from the carrier 24 as a filler 44 remains adhered to the bottom web 30.

The wristband/label assembly 22 of the first embodiment of the parent includes a wristband portion 36 and a tab portion 46. The tab portion 46 preferably includes a label portion 56 having a plurality of individual labels 48, each of which along with the body of the tab portion 46 are identified with an identifying indicia 50, preferably a bar code. While five labels 48 are shown, it is apparent to those of skill in the art that a greater or lesser number of labels could be provided in keeping with the scope of the invention. A release layer 51 preferably underlies the labels 48 and facilitates their removal from the tab portion 46 with a layer of adhesive being carried with each label for adhering the label to any other medium, such as a chart, a tag attached to a bag of belongings such as clothes, a medicine container, etc. Preferably, the wristband portion 36 also is color coded, such as with a coloring 52 along strap portion 54 of the wristband. While any convenient color scheme as known in the art may be utilized, one such convenient scheme is to use black for deceased, red for alive and needing immediate attention for survival, yellow for alive and needing attention for recovery, and green for alive and needing attention for non-life threatening injury. Other color schemes would be apparent to those of ordinary skill, and those color schemes are within the scope of the present invention. The tab portion 46 is separated from the label portion 56 by a die cut, thereby allowing for separation of the labels from the wristband portion, should that be desired, but being retained unless intentionally detached. Each of the labels 48 is defined by a die cut, and has a layer of adhesive and an underlying release layer for easy separation of each label 48 individually from the tab portion 46. Surrounding border members 58 may be peeled away from around the labels 48 to make it easier for them to be removed, such as when medical personnel have gloved hands or in the presence of fluids.

Figure 4:
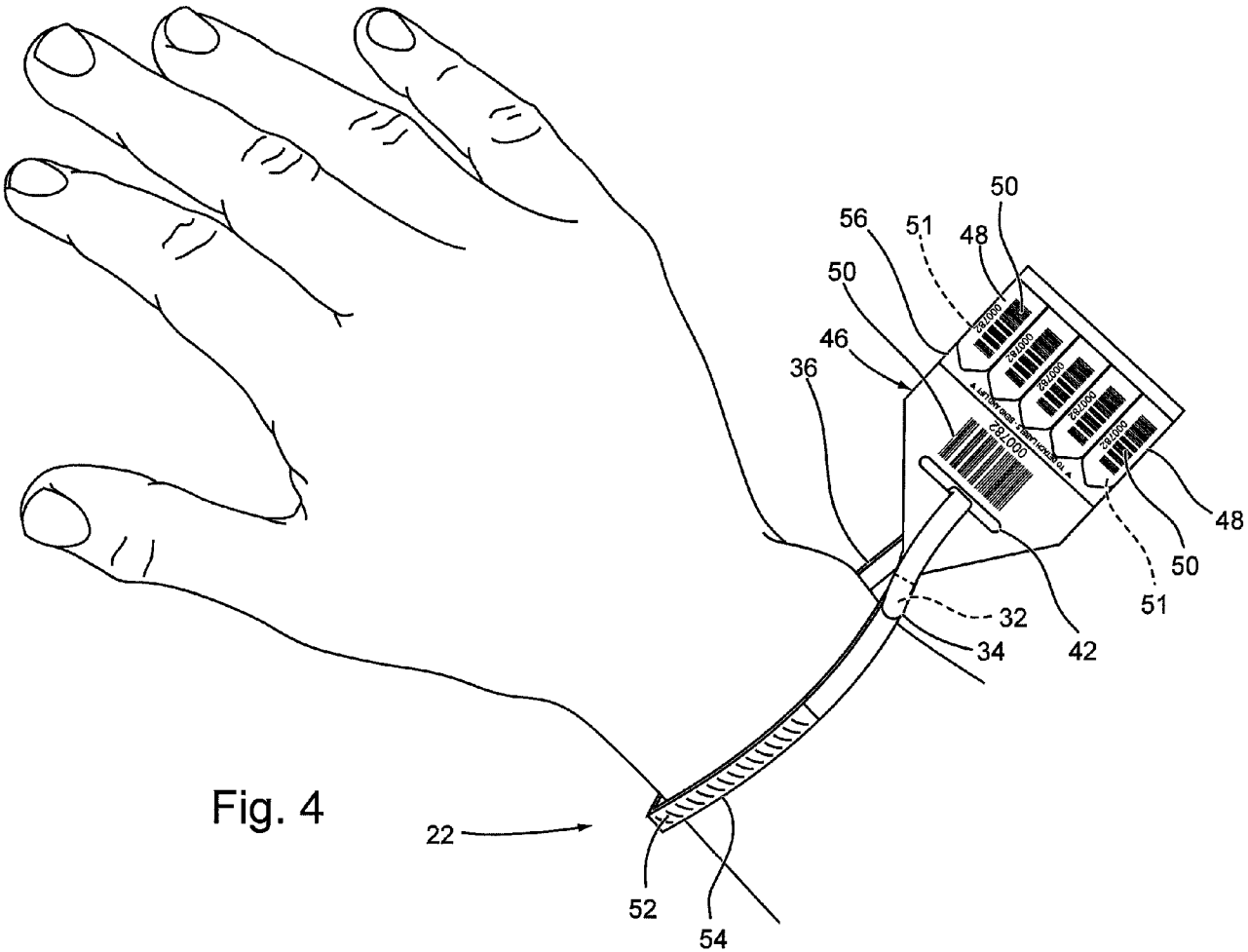
FIG. 4 is a view of the wristband/label assembly applied to a victim's appendage.

As shown in FIG. 4, the wristband/label assembly may be readily applied to a victim, such as around his wrist, by separating it from the carrier, looping the strap portion around the wrist and through the cinch or slot, pulling the strap portion tight as desired, removing the covering over the adhesive applied at the single end of the strap portion, and then affixing the single end to the strap portion to complete the circle or wristband. In this manner, a victim has been color coded as to medical condition, identified with an identifying indicia such as a bar code, and a set of labels have been made immediately available to mark any other items desired to be associated with the victim such as his possessions, his medical charts, medicines being administered, or any other item as desired.

Figure 6:
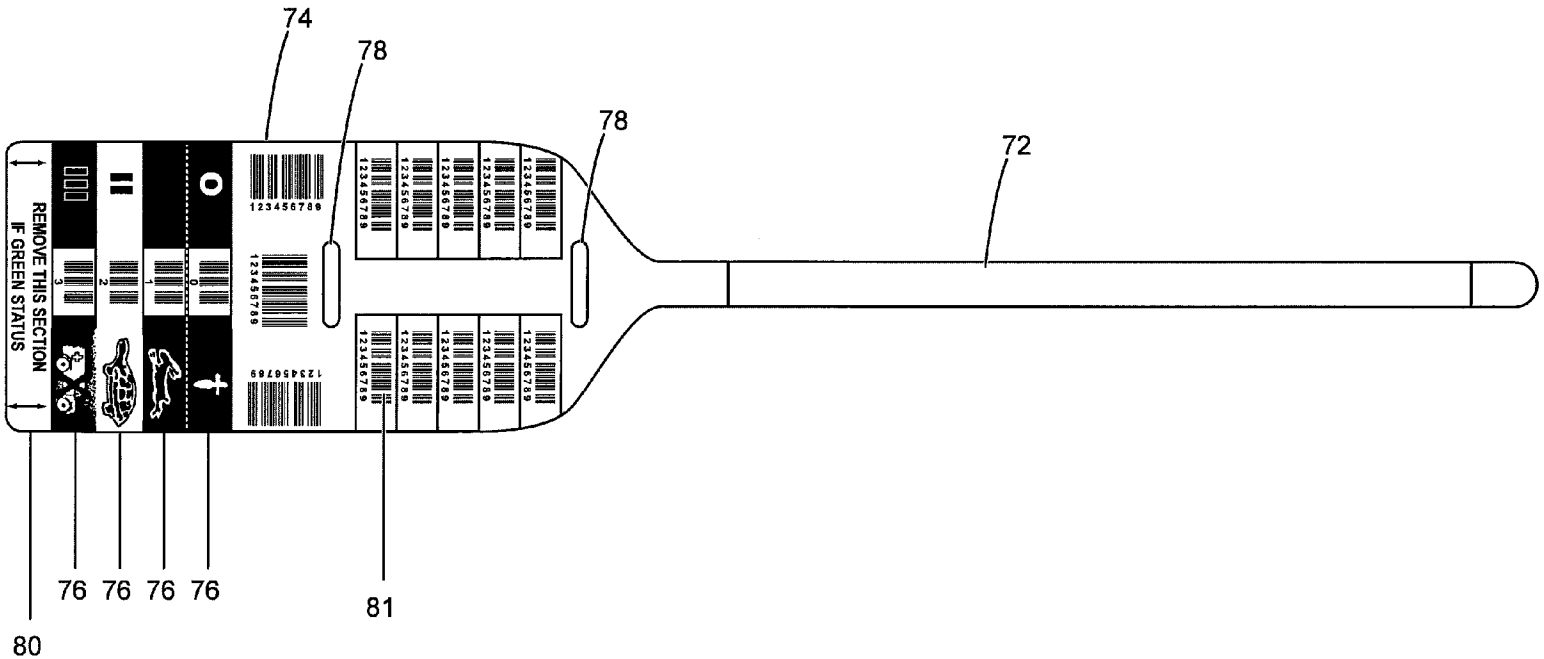
FIG. 6 is a top view of the second embodiment of the business form of the parent invention.
Figure 7:
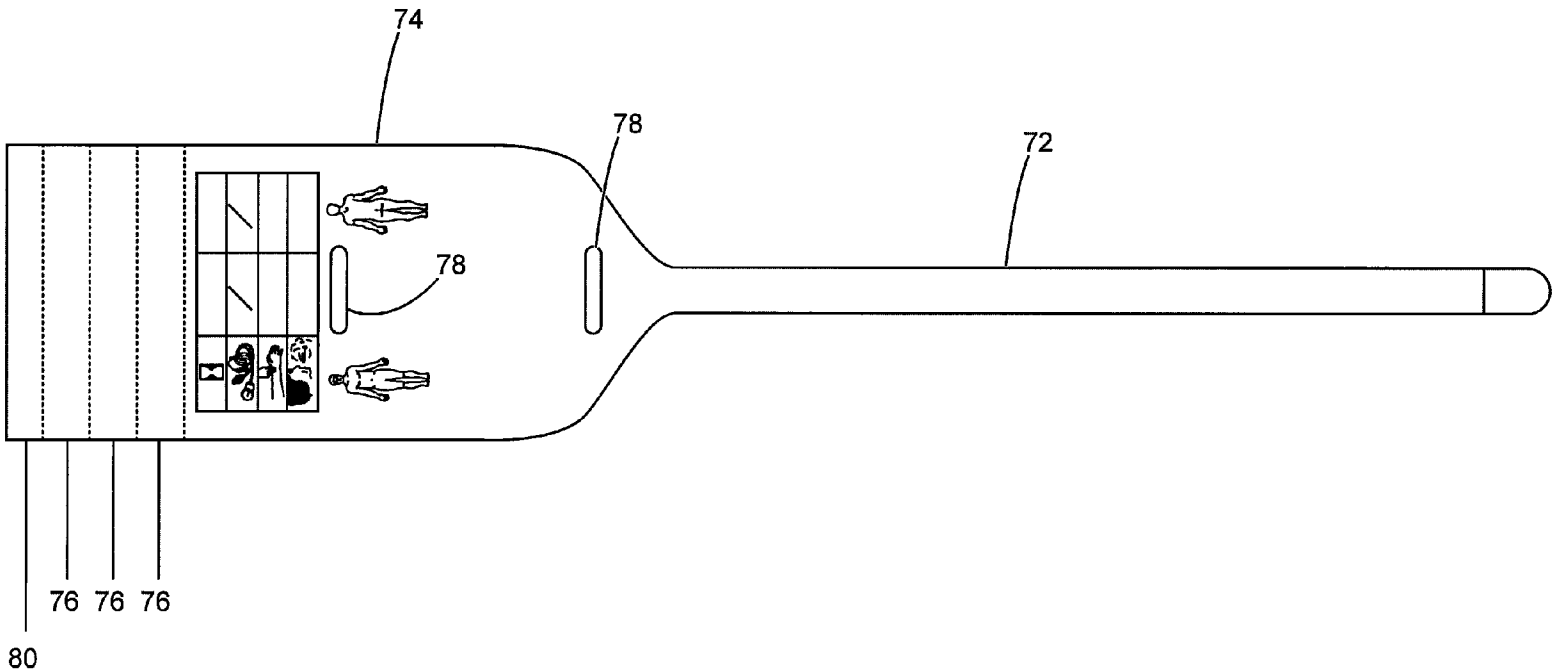
FIG. 7 is a bottom view of the second embodiment.
Figure 8:
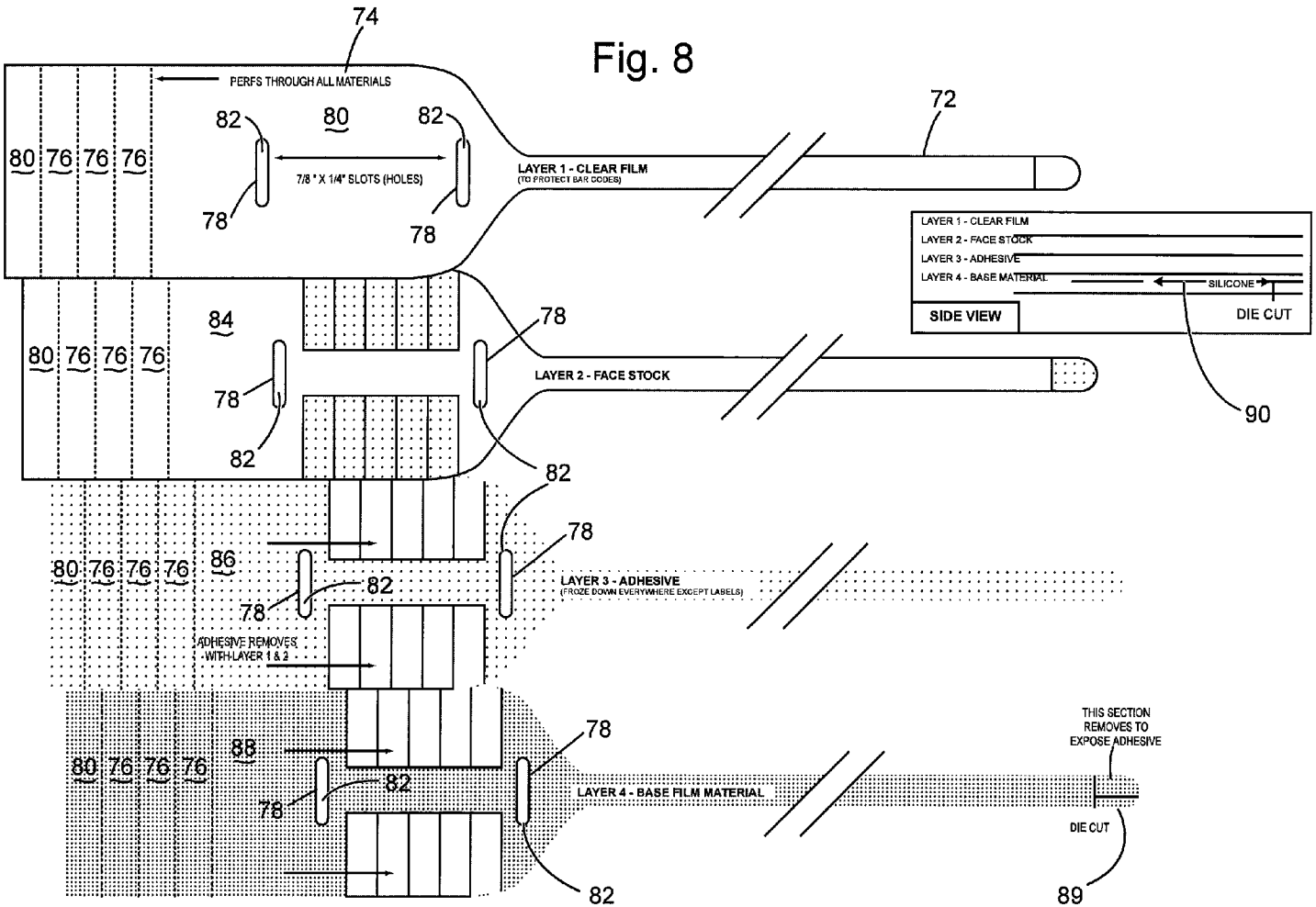
FIG. 8 is an expanded view of the second embodiment, detailing the four layers comprising the second embodiment.

The second embodiment of parent is shown in FIGS. 6-8, and is very similar to the first embodiment except that it is not supplied as part of a sheet type construction from which it must be separated prior to use, is pre-printed, has a different arrangement for indicating medical condition, etc. As shown therein, the second embodiment is completely formed and ready for use without first being separated from a carrier, as with the first embodiment. However, it also has a strap portion 72 and a tab portion 74. While the strap portion may also be color coded, it is preferred that a plurality of separable tabs 76 be provided, along with a dummy tab 80, for separation from the tab portion 74 so that an observer of the applied form may be assured that a conscious effort has been made to indicate medical condition. Otherwise, the dummy tab 80 is present indicating that this feature has not be used, at least as of yet. In addition to color coding, a bar code is also preferably indicated on the individual tabs 76 with each tab 76 having a matching bar code so that the victim's condition may be also scanned into the computer or data base at the same time as the patient's ID bar code. Further information may also be provided on the tabs 76, such as definitional information to instruct a medical technician as to the specific meaning to the various categories to help ensure consistency in marking victims despite the use of multiple and even untrained personnel. This information helps to make the present form almost self teaching as one never knows the quality or training of personnel who will be available when a medical emergency occurs. As shown in FIG. 7, the back of the tab portion 74 may also have additional instructing information, or a place for recordal of vital signs or other medical information such as allergies to medicine or the like. Of further note, as shown in this second embodiment is not one but two cinches 78, comprising slots. This allows the strap portion 72 to be sized more closely to varying dimensions and thus used with a wider variety of appendages. Other similar features are also included such as the bar code labels 81, shown arranged in two columns between the cinch slots 78.

FIG. 8 depicts the four layers used to form the second embodiment, as preferred. The top layer is a web 80 of a clear protective film extending across the entirety of the form, and perforated as noted to allow for the tearing off of tabs 76, 80, and with holes 82 forming the cinch 78. The second layer is comprised of a face stock 84, preferably pre-printed with information as desired with the majority of information contained in the form. The next layer is an adhesive layer 86, preferably a patterned layer and release coating as known in the art as shown, which allows for the removal of tabs 86 with a layer of self adhesive for applying the bar code on ancillary items, as explained in greater detail below. The bottom layer is a web 88 of a base film material which acts to protect the bottom of the face stock web 80. As is noted in the Figures, a patch 89 similar to patch 40 of the first embodiment is shown and which is used to attach the end of strap portion 72 and complete the wristband about the victim's appendage. More particularly, two sections of silicone 90 are shown in a side view inset in FIG. 8, with those sections of silicone lining up with the patch 89 and the bar code labels 81 so that upon separation they carry with them the layer of adhesive making them self adhering.

Figure 5:
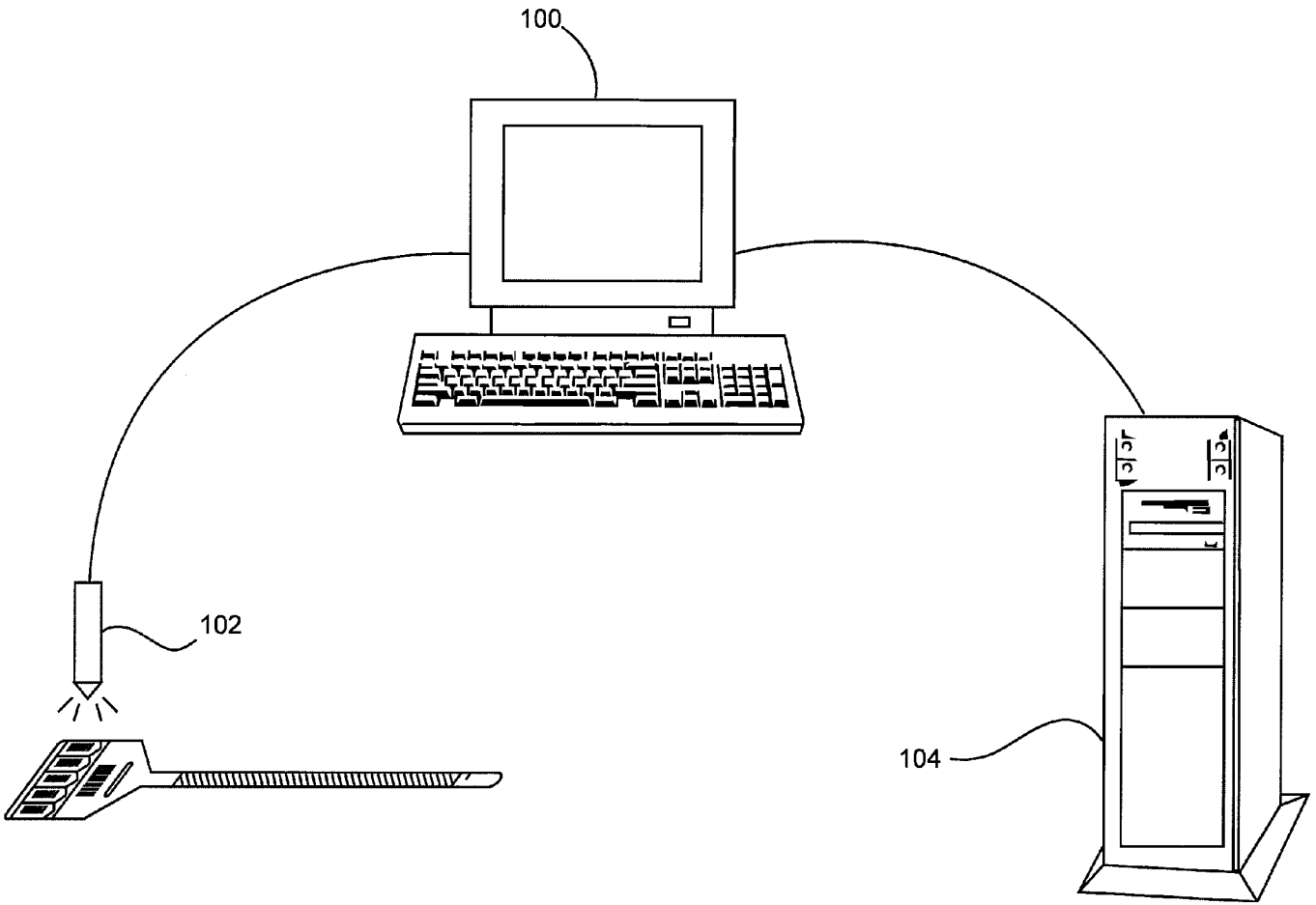
FIG. 5 is a diagram of the computer system used to implement the method of collecting and displaying over the internet the victim data.

As shown in FIG. 5, as the victims are processed, the parent invention also contemplates that this information may be input to a computer 100, the bar code being read in with a bar code swiper 102 or the like for preferably both of patient ID and medical condition, and then this information may be transmitted over the internet to a server 104 for collating and display at a web site. Multiple computers 102 could be readily connected to the same server 104, as is known in the art, and handle the input from a number of medical facilities at the same time. This permits this information to be made available almost immediately as victims are processed, through the web and at remote locations, eliminating the anxiety of family members who physically search for their relatives or loved ones.

While the principal advantages and features of the parent invention have been illustrated through an explanation of its preferred embodiment, there are other aspects and variations of the parent invention as would be apparent to those of skill in the art. For example, rather than bar coding, other identifying indicia could be used on the form. The form could be used in other applications other than in emergency situations in the field. Rather than color coding, other coding or indicators could be used to sort victims, or they could be sorted into other categories according to differing medical categories, or coding could be dropped from the form, as desired. Other construction could be used for the form, including especially the wristband portion, such as self laminating construction and the wristband would still be protected from damage during its single use. Other means could be used to attach the wristband rather than looping a single end around and through a slot. Another form of a cinch could be used, or a different arrangement of the cinch. Still other variations would be apparent to those of skill in the art, and the parent invention is intended to be limited solely by the scope of the claims appended hereto, and their legal equivalents.

Figure 9:
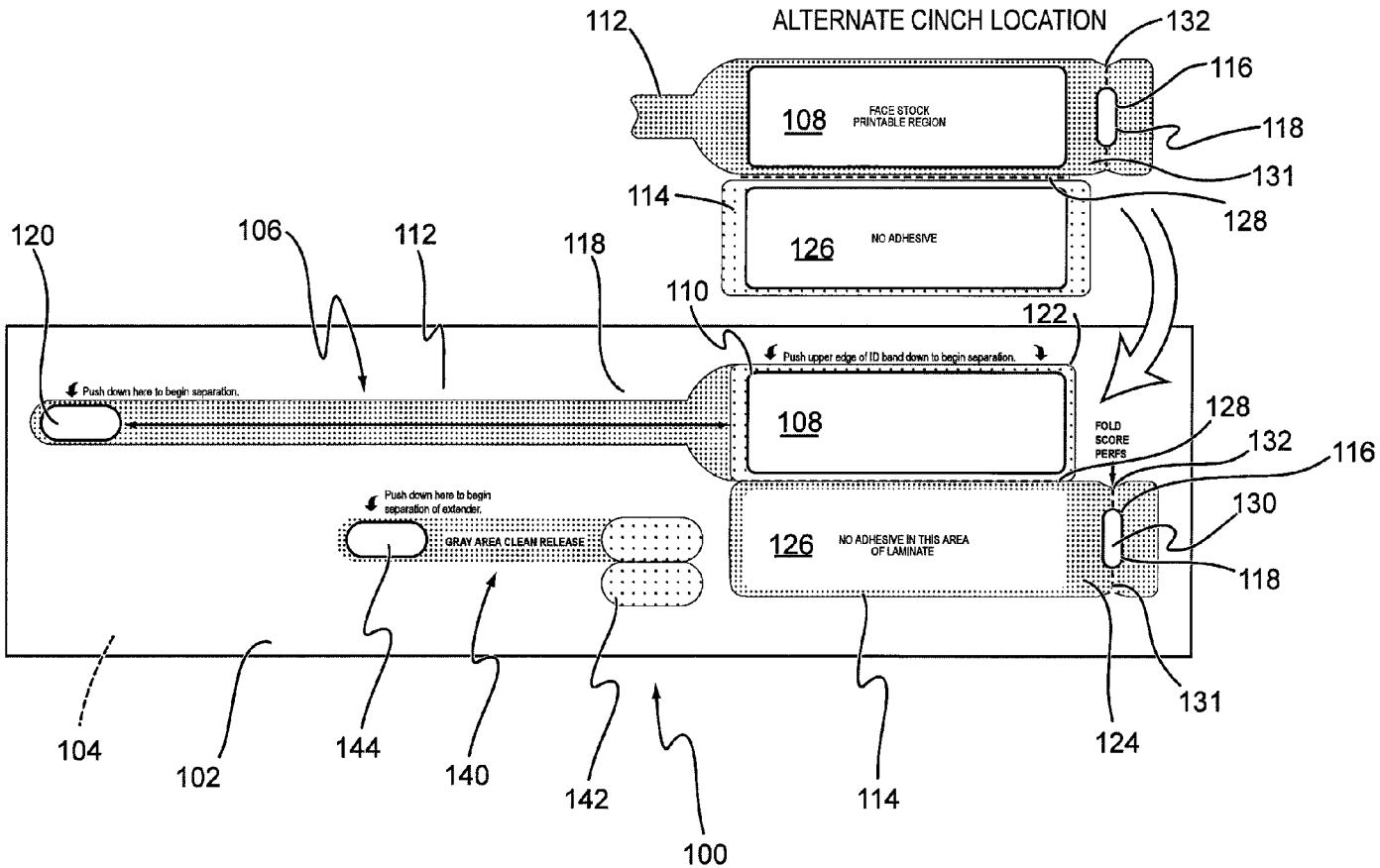
FIG. 9 is a top view of the first embodiment of the self laminating wristband with an inset depicting an alternate location for the cinch, and an extender formed in an approximately envelope size sheetlet.

The present invention 100 is shown in FIG. 9 and is depicted therein as formed in a two layer, sheetlet sized construction of about 3 inches by 11 inches. The top layer 102 is preferably a face stock, such as bond or the like as would readily accept a printed image from a laser printer or other computer controlled printer, and a bottom laminate layer 104 which underlies the face stock layer 102 and is joined by a patterned adhesive layer including portions which are release coated, as will become apparent upon further reading. The invention 100 generally comprises a self laminating wristband 106 having a printable region 108 of face stock defined by a die cut 110 therein, and an integrally formed strap portion 112, laminating portion 114, and cinch 116 similarly formed by a die cut 118 in the laminate layer 104. A patch of face stock 120 is also die cut into the face stock layer 102, and covers a patch of adhesive with which the strap portion is adhered as the wristband 106 is applied to a patient, as will be explained. The length of strap portion 112 is covered by a release coating so that after it is removed from the sheetlet 100 it does not carry any adhesive with it. The laminating portion 114 has a layer of adhesive between a top portion thereof 122 and the face stock region 108 to adhere it thereto. However, a bottom portion 124 of the laminating portion 114 has a window 126 of area where no adhesive is applied so that as the laminating portion is folded over there is no layer of adhesive covering the printable region 108. A fold or perf line 128 if formed between the laminating portion halves 122, 124 as an aid in forming the wristband 106 after it is separated from the sheetlet 100. The cinch 116 generally comprises a slot 130 formed in an extension 131 and aligned generally perpendicularly to the face stock region 108 and strap portion 112 for easy insertion of the strap portion 112 therethrough. There is also provided a fold or perf line 132 along the central axis of the slot 130 through the width of the extension 131, and adhesive covers the extension 131 so that the extension 131 may be folded over onto the strap portion 112 after it has been threaded through the slot 130 to its desired length. The extension 131 and cinch 116 are shown to be adjacent the bottom half 124 of laminating portion 114, which results in the adhesive layer of the extension 131 facing towards the patient's wrist as the wristband is applied. Alternatively, the extension 131 and cinch 116 may be formed adjacent the top half 122 of the laminating portion 114 as shown in the inset of FIG. 9 and with this construction the extension adhesive faces away from the patient as the wristband is applied. With this alternative arrangement, the wristband may lie flatter against the patient, as the other arrangement creates a small tab which may or may not lie flat depending on how tight the wristband is drawn. However, this is not considered significant.

In use, this wristband embodiment is first separated from the carrier sheetlet by pushing down on the end of the strap and/or the die cut face stock area 108, and peeling it away, thereby separating a matrix comprising the wristband assembly. The laminating portion 114 is then folded together to enclose the printed face stock region. The wristband is next applied to the patient's wrist by wrapping the strap about the wrist, inserting it through the cinch, folding over the extension to adhere it to the strap, and then exposing the adhesive on the end of the strap and adhering it back onto itself to secure the excess strap. The caregiver can chose the tightness of the wristband by threading more or less of the strap through the slot in the cinch before adhering the strap to the extension.

Also shown on the sheetlet 100 is an extender 140 generally comprising a clamshell joinder portion 142 at one end of a length of laminate layer 104 and a patch of face stock 144 covering a patch of adhesive at the other end. The extender 140 may be used to extend the effective length of strap portion 112 and is applied by adhering the clamshell portion 142 anywhere along the length of strap portion 112 and using the patch of adhesive on the extender 140 to join the strap portion 112 to itself as just described. The length of extender 140 is adhesive free, as the strap portion 112, so that no adhesive is exposed to the patient's skin.

Figure 10:
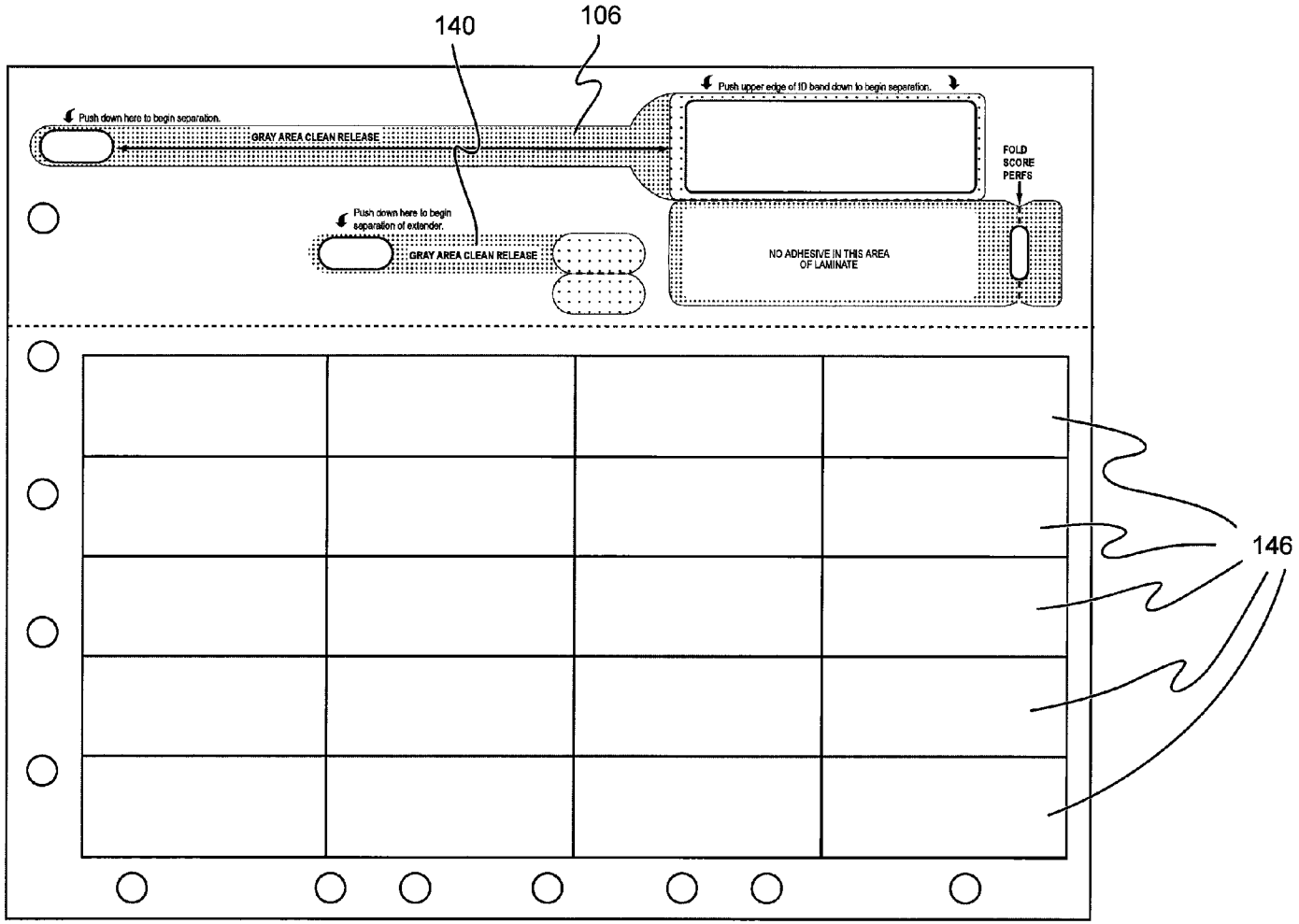
FIG. 10 is a top view of the first embodiment of the self laminating wristband and extender formed in a page sized sheet with a plurality of self adhering labels.

As shown in FIG. 10, the wristband 106 and extender 140 may be included as part of a page sized sheet along with a plurality of self adhered labels 146. As with previous inventions shown in the inventor's prior patents, it has been found to be desirable to print identifying information relating to a patient not only on a wristband but also on labels which may then be separately peeled off as needed to label items dedicated for use by the patient or to identify other medical items such as blood samples, tissue samples, etc. Thus there has found to be a need for the present invention configured as shown in FIG. 10.

Figure 11:
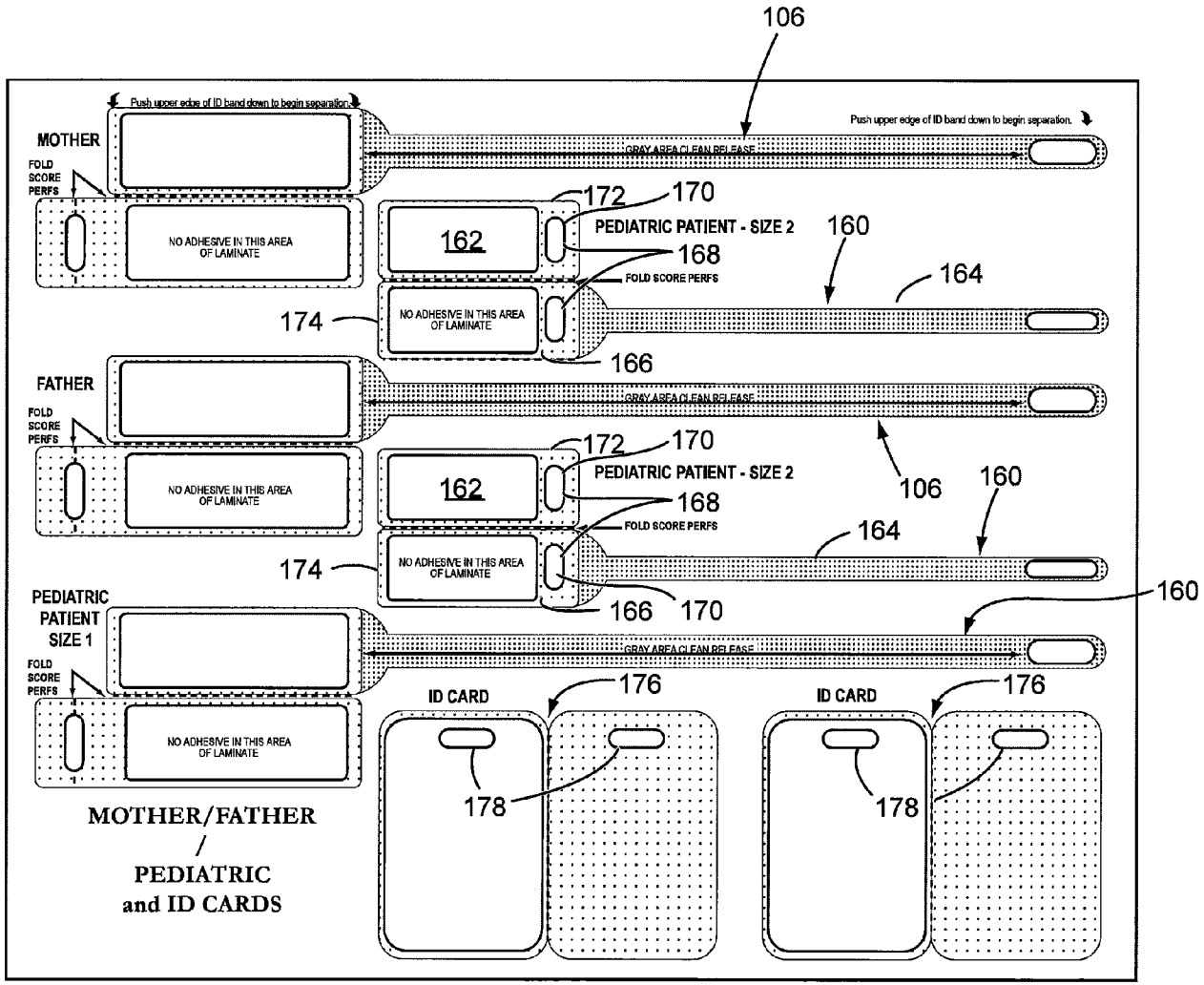
FIG. 11 is a top view of a page sized sheet having a plurality of self laminating wristbands of varying lengths, and depicting an alternate construction for the wristband, coupled with a pair of ID cards.

As shown in FIG. 11, a page sized form may also be provided with a mix of wristbands 106 as well as a different embodiment of wristband 160, which is preferably somewhat smaller in length than wristband 106, and which has a slightly different arrangement for the cinch. As shown therein, there are two wristbands 160, each of which has a printable face stock region 162 die cut from the face stock layer as with wristband 106. And, a strap portion 164, laminating portion 166 and cinch portion 168 are also die cut into the laminate layer, as with wristband 106. However, cinch portion 168 comprises a pair of slots 170 die cut adjacent both of the top half 172 and bottom half 174 of laminating portion 166, so that as the two halves 172, 174 are folded over to laminate faces stock region 162, the slots 170 are aligned to overlie each other and create a single opening intermediate the face stock region 162 and strap portion 164. With the cinch located in this position, several differences are noticeable. First, the wristband 160 may conveniently circumscribe a smaller circumference so that it may readily fit onto a smaller wrist, such as a baby's, as it takes the face stock region 162 and laminating portion 166 out of the loop forming the wristband. Instead, the face stock region 162 and laminating portion 166 form into a "hang tag" which essentially hangs from the strap portion 164 after the wristband 160 is applied to a patient. Note that the strap portion 164 extends from the bottom half 174 in this embodiment instead of from the top half 172 as in the first embodiment, thereby allowing the strap portion 164 to wrap around and through the cinch portion 168 and then back onto itself without passing over or obscuring the face stock region 162. Although this wristband 160 construction is shown as being adapted for smaller wrists, it may also be used with a longer strap portion 164, or with an extender 140, and may be viewed as a matter of design choice. Also shown on the sheet are a pair of ID cards 176, that are themselves self laminating, with a slot 178 for convenient attachment directly to either of the wristbands 106, 160, or separately to a clip or for being carried in a user's wallet. This assemblage of wristbands and ID cards has been found to be especially useful for pediatric situations with a wristband for each parent, an ID card for each parent, and two smaller wristbands for one or two babies or children.

Figure 12:
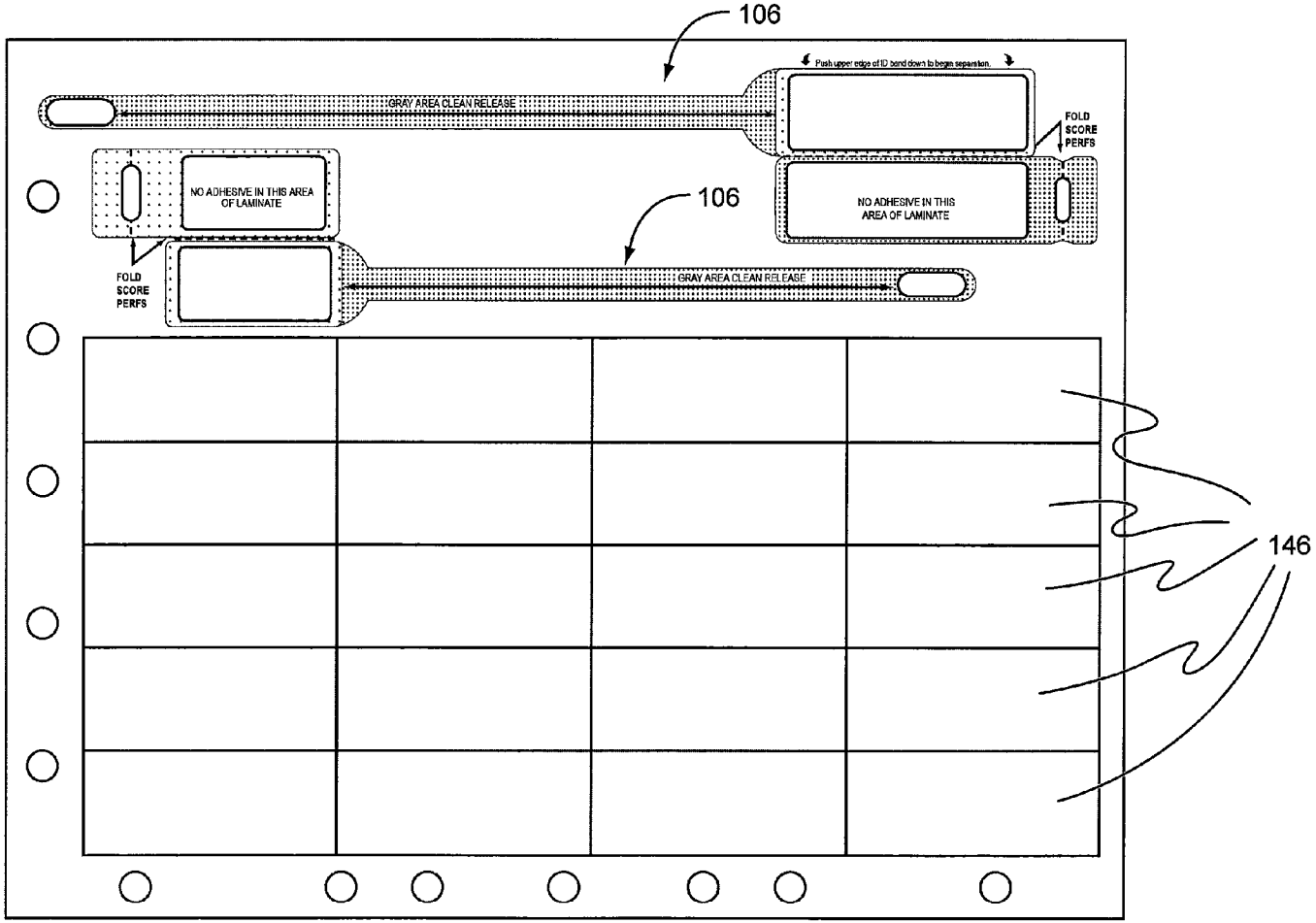
FIG. 12 is a top view of a page sized sheet having a pair of wristbands and a plurality of self adhering labels.
Figure 13:
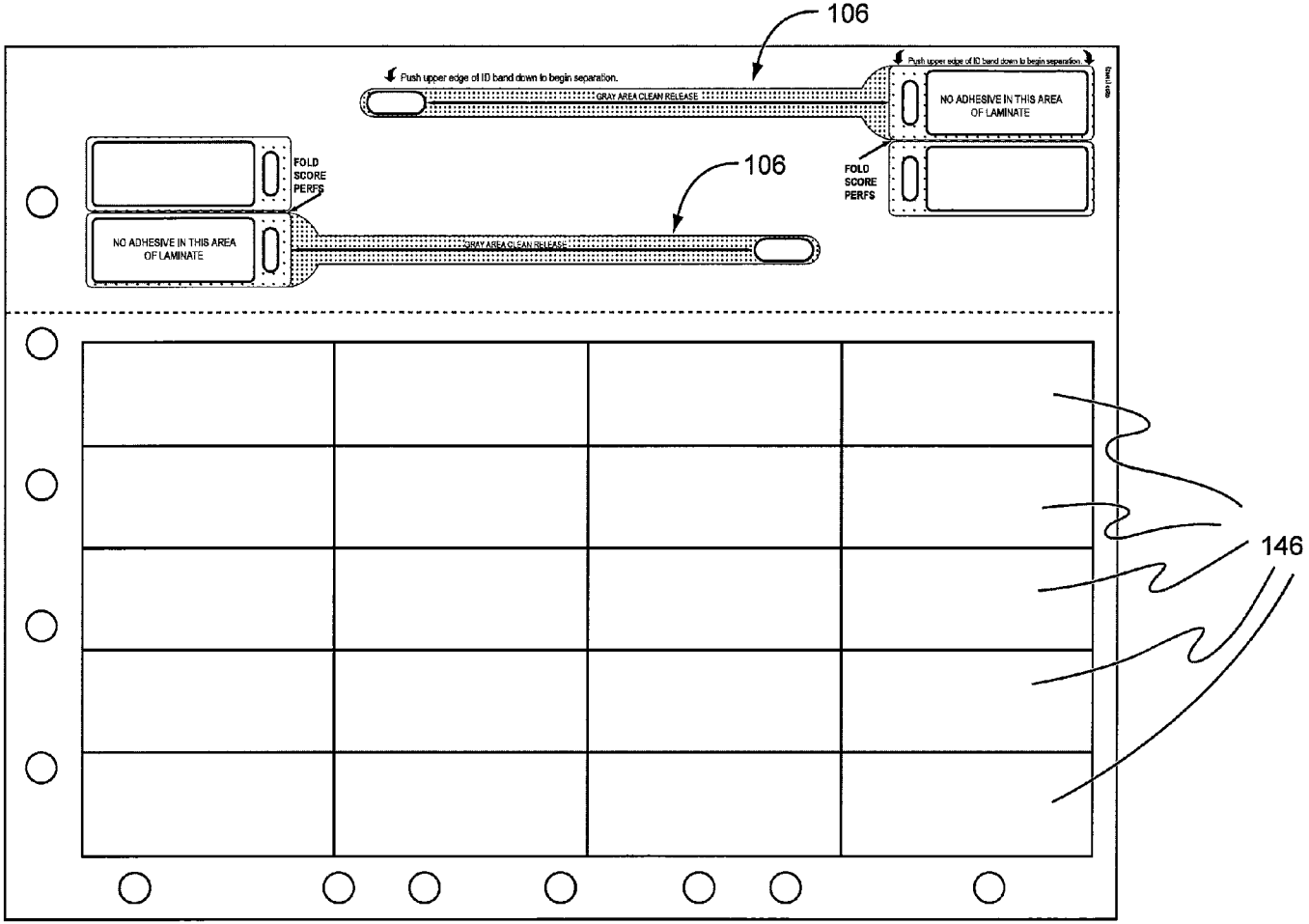
FIG. 13 is a top view of a page sized sheet having a pair of wristbands of alternate construction and a plurality of self adhering labels.

FIG. 12 depicts a sheet sized form containing two wristbands 106 along with a plurality of self adhering labels 146 which is a slightly different configuration than that shown in FIG. 10, but with the same inventive wristbands being used. FIG. 13 depicts a sheet sized form similar to that shown in FIG. 12 except that an alternative wristband 160 is used. While the inventor has found that these particular groupings of products have met with acceptance and commercial success for particular applications, other combinations of wristbands, of different construction, with or without labels or ID cards, may be found desirable as a matter of design choice.

The invention has been disclosed herein in several embodiments with several alternatives to the construction of the wristband of the present invention, as well as other inventive features and accessories including an extender. It will be appreciated by those of ordinary skill in the art that various alternatives not specifically mentioned are well within the scope of the invention. Some of these alternatives include the choice of specific materials for each layer of face stock or laminate, the particular adhesive used, and other details of construction for the page sized sheet in which the wristband is formed. The particular length or shape of the strap may be varied to adapt to the particular application, the location of the patch of adhesive at the end of the strap may be changed, the point at which it extends from the laminating portion, and other arrangement details may also be considered as part of the invention. While it is considered as desirable by the inventor to not laminate the strap portion, there is no reason why it need not be laminated. The preferred embodiments disclosed herein are intended to be exemplary and not limiting as to the subject matter of the invention. Other similar, or different, changes will be contemplated and those changes are to be considered as part of this invention which should be limited only by the scope of the claims as appended hereto, and their legal equivalents.

What is claimed is:

1. A two ply printer processible business form page having a wristband defined by a die cut therein and being separable therefrom, the wristband comprising a clamshell with an integrally formed elongate member extending from only one end thereof, the clamshell and elongate member being formed in a single ply, each portion of the clamshell being substantially of the same dimensions and having a width greater than that of the elongate member and the elongate member having a length substantially greater than the clamshell length, with the clamshell being at least partially covered with adhesive and with only a portion of said adhesive being exposed when the wristband is separated from the page to thereby be adapted to be folded together after separation thereof from the page and thereby join the wristband.

2. The business form page of claim 1 wherein each clamshell portion comprises a pair of panels, with only one of said panels having a layer of adhesive exposed upon separation of said wristband from said page for joining said panels when folded together.

3. The business form page of claim 2 wherein said elongate member is substantially free of adhesive along a majority of its length and wherein the other of said panels has a layer of covered adhesive upon separation of said wristband from said page.

4. The business form page of claim 3 wherein the elongate member comprises a single strap extending solely from one end of said clamshell, and wherein at least a portion of the clamshell is folded over to clamp the strap to thereby join the strap and secure the wristband to a wearer's wrist.

5. The business form page of claim 4 wherein said single ply is adhered to said second ply.

6. The business form page of claim 5 further comprising a die cut in said second ply defining a portion thereof adhered to one of said panels, said second ply portion being intended to remain adhered to said one panel as said wristband is separated from said page.

7. The business form page of claim 6 wherein said second ply portion covers a substantial portion of said one panel.

8. The business form page of claim 1 wherein said elongate member comprises a strap, said strap being substantially free of adhesive along the entirety of its length, and wherein at least a portion of said clamshell has a layer of adhesive and may be folded over to adhere a distal end of said strap to thereby join it to the clamshell and affix the wristband to a wearer's wrist.

9. The business form page of claim 8 wherein the clamshell comprises pair of panels and said strap is less than half as wide as either panel.

10. The business form page of claim 9 wherein the page is shaped in substantially the shape of a rectangle, and wherein the wristband extends more than half the length of the longest dimension of said page.

11. The business form page of claim 10 wherein said first and second plies are co-extensive, are made of different materials, and the page is comprised solely of said two plies.

12. A printer processible business form page comprising a pair of plies, with at least one die cut forming a wristband therein, said wristband being separable from said page along said at least one die cut, said wristband comprising a clamshell with only one elongate member, said one elongate member extending to one side of said clamshell, said clamshell and elongate member being formed by a die cut into only one of said plies and having a layer of adhesive applied to at least a portion thereof, the second of said plies comprising a liner ply, a portion of said liner ply separating from said page as said wristband is separated from said page to thereby cover only a portion of the adhesive layer and leave another portion of said adhesive layer exposed, and said clamshell comprising a pair of opposing panels with each of said panels having a width larger than the elongate member.

13. The business form page of claim 12 further comprising a second die cut in the liner ply defining a portion thereof adhered to one of said panels, said liner ply portion being intended to remain adhered to said one panel as said wristband is separated from said page.

14. The business form page of claim 12 wherein at least a portion of said clamshell panels may be folded over to capture a distal end of the elongate member to thereby secure it.

15. The business form page of claim 12 wherein the page is shaped in substantially the shape of a rectangle, and wherein the wristband extends substantially the length of the longest dimension of said page.

16. The business form page of claim 12 wherein said pair of plies are co-extensive, are made of different materials, and the page is comprised solely of said pair of plies.

17. The business form page of claim 12 wherein the elongate member comprises a strap, said strap having a width less than half the width of either panel and substantially free of adhesive along a majority of its length.

18. A printer processible wristband separable from a business form carrier, said business form carrier being provided intact and suitable for printer processing prior to separation of said wristband from said business form carrier, said wristband being formed by a die cut in said business form carrier and comprising a clamshell with only one integrally formed elongate member, at least part of said clamshell having a layer of adhesive applied thereto, a portion of said adhesive layer being exposed and another portion of said adhesive layer remaining covered upon separation of said wristband from said carrier, said only one elongate member comprising a strap and extending to a side of said clamshell, said clamshell and strap being formed in a single ply and said clamshell having a width substantially greater than said elongate member to thereby be adapted for being secondarily processed through a printer to thereby apply printed information thereon and wherein a portion of said clamshell may be folded over to adhere an end of said strap to thereby secure it and thereby affix the wristband to a wearer's wrist.

* * * * *